United States Patent [19]

Meschi

[11] Patent Number: 4,466,767

[45] Date of Patent: Aug. 21, 1984

[54] AUTOMATIC APPARATUS FOR THE POSITIONING AND REMOVAL OF THE CASING OF PAPER BOARD BOXES

[75] Inventor: Luciano Meschi, Leghorn, Italy

[73] Assignee: Wully S.A., Panama

[21] Appl. No.: 356,339

[22] Filed: Mar. 9, 1982

[30] Foreign Application Priority Data

Mar. 10, 1981 [IT] Italy ..... 20237 A/81

[51] Int. Cl.[3] ..... B65G 65/34

[52] U.S. Cl. ..... 414/411; 53/381 A; 414/417

[58] Field of Search ..... 53/381 A; 414/411, 412, 414/417

[56] References Cited

U.S. PATENT DOCUMENTS

| | | | |
|---|---|---|---|
| 1,556,438 | 10/1925 | Hanson | 414/417 |
| 2,950,829 | 8/1960 | McBean | 414/412 |
| 3,019,925 | 2/1962 | Gray | 414/417 |
| 3,342,018 | 9/1967 | Temple | 414/411 X |
| 3,853,235 | 12/1974 | Lambert | 414/412 |
| 3,889,442 | 6/1975 | Grahn | 414/412 X |
| 3,979,876 | 9/1976 | Moore | 53/381 A X |

*Primary Examiner*—John Sipos

*Attorney, Agent, or Firm*—McAulay, Fields, Fisher, Goldstein & Nissen

[57] ABSTRACT

For paper board boxes, comprising a cover and a casing or container with pullable down side walls which are telescopically coupled, an automatic apparatus is provided for positioning the boxes in a predetermined position, removing the cover, pushing away the contents of the box from the casing having the side wall folded flat or pulled down onto the bottom plane and lastly removing the thus set free and flattened casing.

12 Claims, 8 Drawing Figures

AUTOMATIC APPARATUS FOR THE POSITIONING AND REMOVAL OF THE CASING OF PAPER BOARD BOXES

FIELD OF THE INVENTION

The present invention relates to an automatic apparatus for the positioning of a paper board package or box, comprising a paper board casing or container, having foldable side walls, and a cover telescopically coupled to the container, in a desired position and removing the contents of the box from the casing in an automatic manner and with a separate recovery of the two component parts (casing and cover) of the box.

In the following description particular reference will be made to the use in the systems for the feeding of form packages, the forms being joined as a continuous strip and folded so as to form packages which, for the transport and the handling, are contained in paper board boxes having foldable walls, said packages being used for the feeding of the printing apparatus of electronic accounting and data processing centers, but such a reference by way of example only and should not be construed as a limitation of the possible uses of the apparatus of the invention.

PATENT INFORMATION STATEMENT

In European patent application No. 81104840.4 an apparatus is described for the automatic splicing of the last form or sheet of a form package (which preferably is that from which the removal of the forms feeding the printing apparatus is already taking place), with the first form of another package, whereby when the first package is exhausted the feeding to the printing apparatus continues in an industurbed manner, without undue interruptions which may heavily affect the production rate of the printing apparatus itself.

It is known that these form packages are normally packed, transported and handled in paper board boxes, from which the forms are removed at the time of use thereof. However the removing operation does not only involve dead times and labor intervention, but gives also place to two problems, namely that of the at least temporary storage of the casing and of the covers, and that of the damaging of the boxes, which normally occurs when the compacting operation is carried out, whereby their reuse becomes impossible.

In the European Application No.82100518.2 a particular paper board box is described wherein, according to a preferred embodiment, the vertical side panels of the casing or container are not joined to each other at the corners, whereby the container takes a parallelpipedal shape only when the side panels are retained in vertical positions from the cover which is telescopically coupled thereto.

According to a further preferred embodiment, one of the side panels is omitted, thus making easier the removal of the container with the side panels pulled down flat onto the horizontal plane containing the bottom of the container, upon the cover has been removed and the side panels are thus able to freely falling down onto the horizontal plane.

OBJECTS AND SUMMARY OF THE INVENTION

The main purpose of the present invention is that is providing an automatic apparatus, by which the form package boxes are positioned one by one in a predetermined position, the cover is telescopically removed from the box, the form package is pushed with relative motion with respect to the bottom of the box, and the box bottom is taken away from the said predetermined position, upon the form package is disengaged from said bottom and from whatever other member of the box.

This and other purposes, which shall appear in the following description, are achieved by means of an apparatus comprising a sliding plane onto which a predetermined position is set for the opening and disengagement of the box from the package; revealing means for signalling the presence of a box in the said predetermined position; first means for the engagement and the removal of the cover and of the container respectively from said predetermined position, said first means being movable between a rest position and an operating position in which the component to be removed is engaged by respective grasping means; second pushing means by which the form package contained in the box is engaged and made to slide with respect to the bottom fo the container of the box until the position of reciprocal disengagement is attained, said second means being movable between a rest position and an operating position in which thrusting means engage the form package, and first and second retaining means, said first retaining means being fixed and adapted to engage with a retaining action the edges of two opposed side panels of said container, when are in the condition pulled down onto the bottom plane of the container, and said second retaining means being movable between a retaining position in which said form box is stopped in said predetermined positiog and a rest position in which no interference exists with the said relative motion between the form package and the casing or container.

BRIEF DESCRIPTION OF THE DRAWING

The specific features and advantages of the present invention shall more clearly appear from the following detailed specification, related to the enclosed drawings, showing a preferred embodiment.

In the drawings.

DISCLOSURE OF BEST MODE

Figure 1:
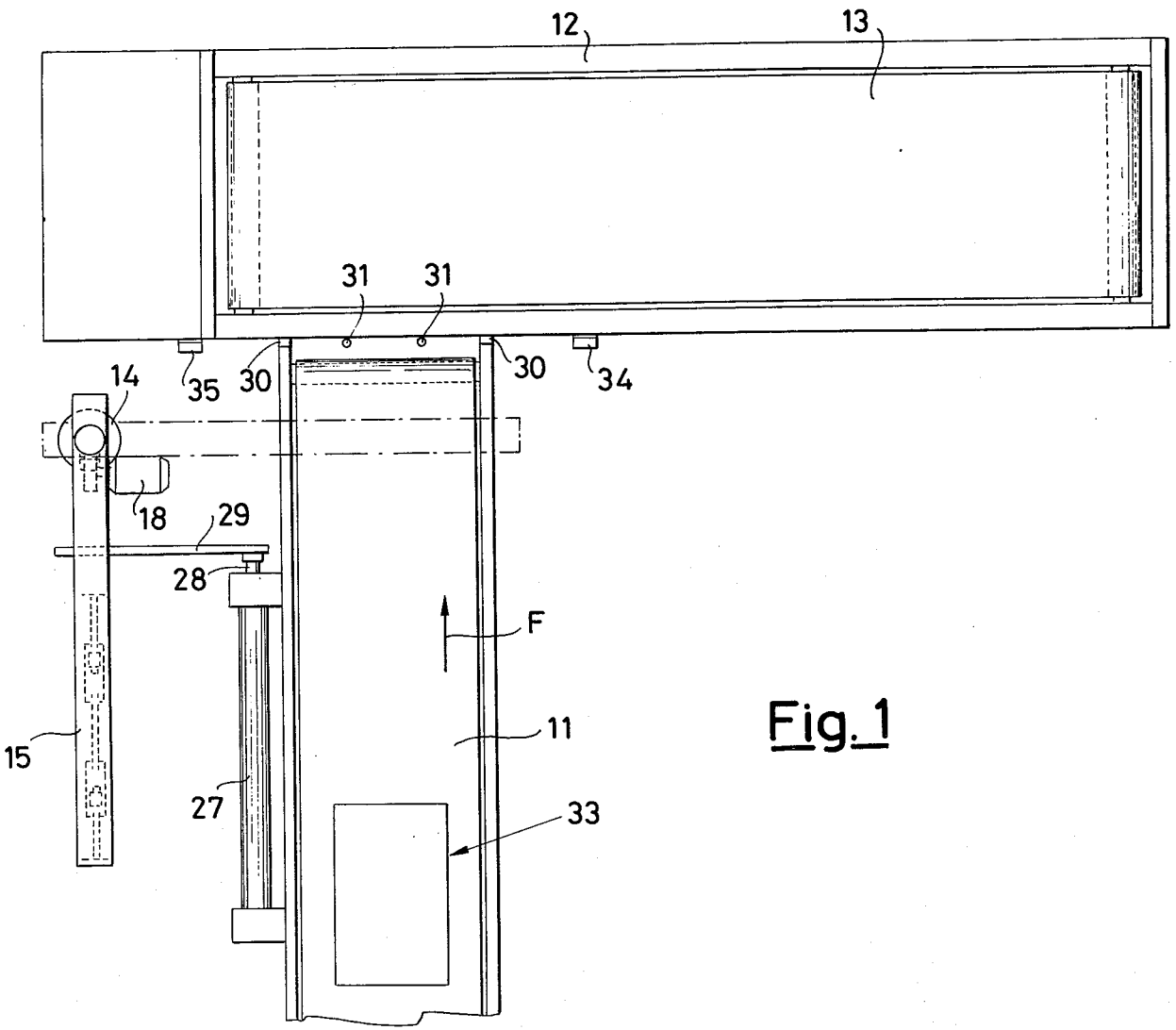
FIG. 1 is a plan view from above of the apparatus of the invention in the rest condition, namely at the beginning of an operating cycle.
Figure 2:
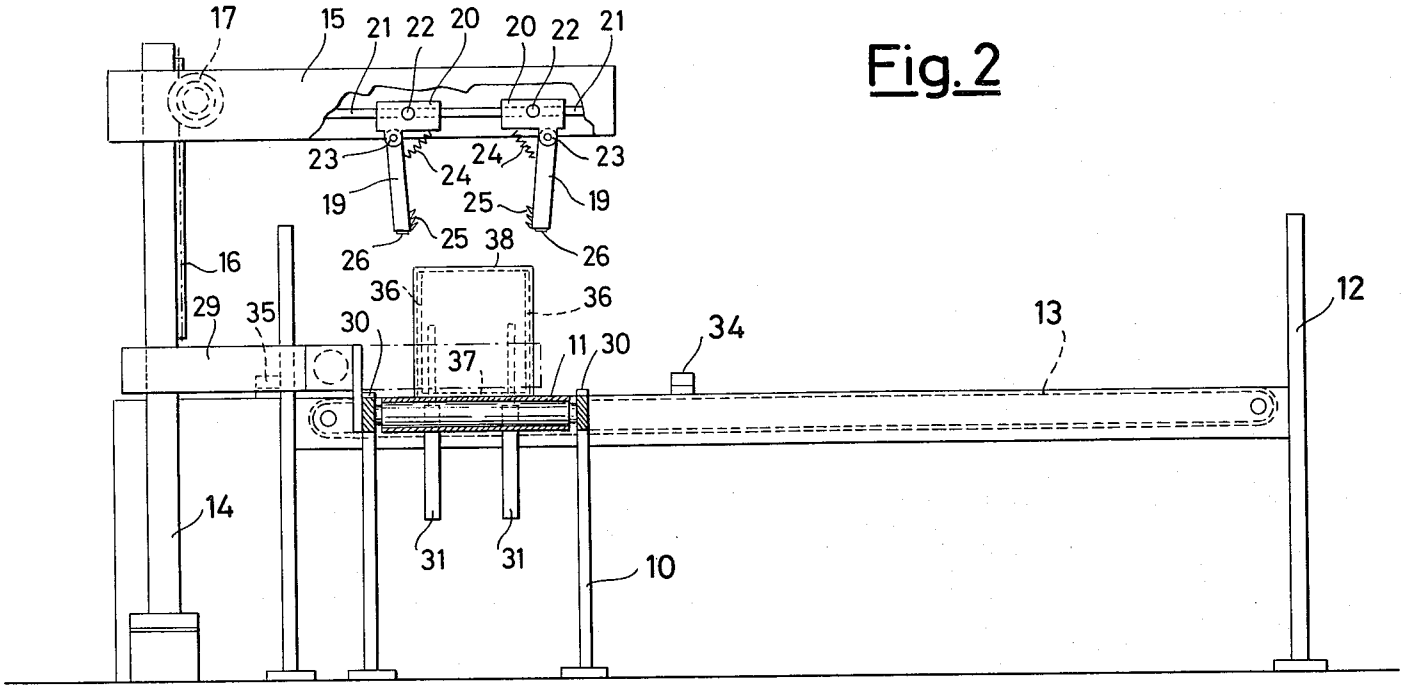
FIG. 2 is a side, partially cross-sectional view of the apparatus of FIG. 1.

Referring firstly to FIGS. 1 and 2, the apparatus according to the invention comprises a frame 10, having a conveying belt 11, driven by driving means (not shown), and advanced, controlledly and intermittently, in the direction of the arrow F.

At the end of the sliding plane as defined by the conveying belt 11 a receiving plane 12 is provided, preferably having a conveying belt 13 like the conveyor belt 11.

Sideways with respect to the frame 10 a column 14 is mounted, having at the upper end an arm 15, rotatable between a rest position, shown in FIG. 1 by solid lines, and an operating position, shown in FIG. 1 by dashed lines.

The arm 15 is movable under control along the column 14 by means of a mechanism comprising a rack 16 and a pinion 17, the latter being coupled to an electrical motor or to a geared motor of known type.

The arm 15 has affixed thereto a pair of self-centering jaws 19, fastened by means of the eyelet 21 in which the locking screws 22 are engaged.

The jaws 19 are pivoted at 23 to the blocks 20 and are thrusted towards each other by springs 24.

At the ends of the jaws 19, but laterally thereof, teeth 25 are provided having the hereinafter described purpose, whereas suction cups 26, positioned at the end of the jaws 19, are connected, in a manner not shown, but known per se to a vacuum or depression source.

Figure 5:
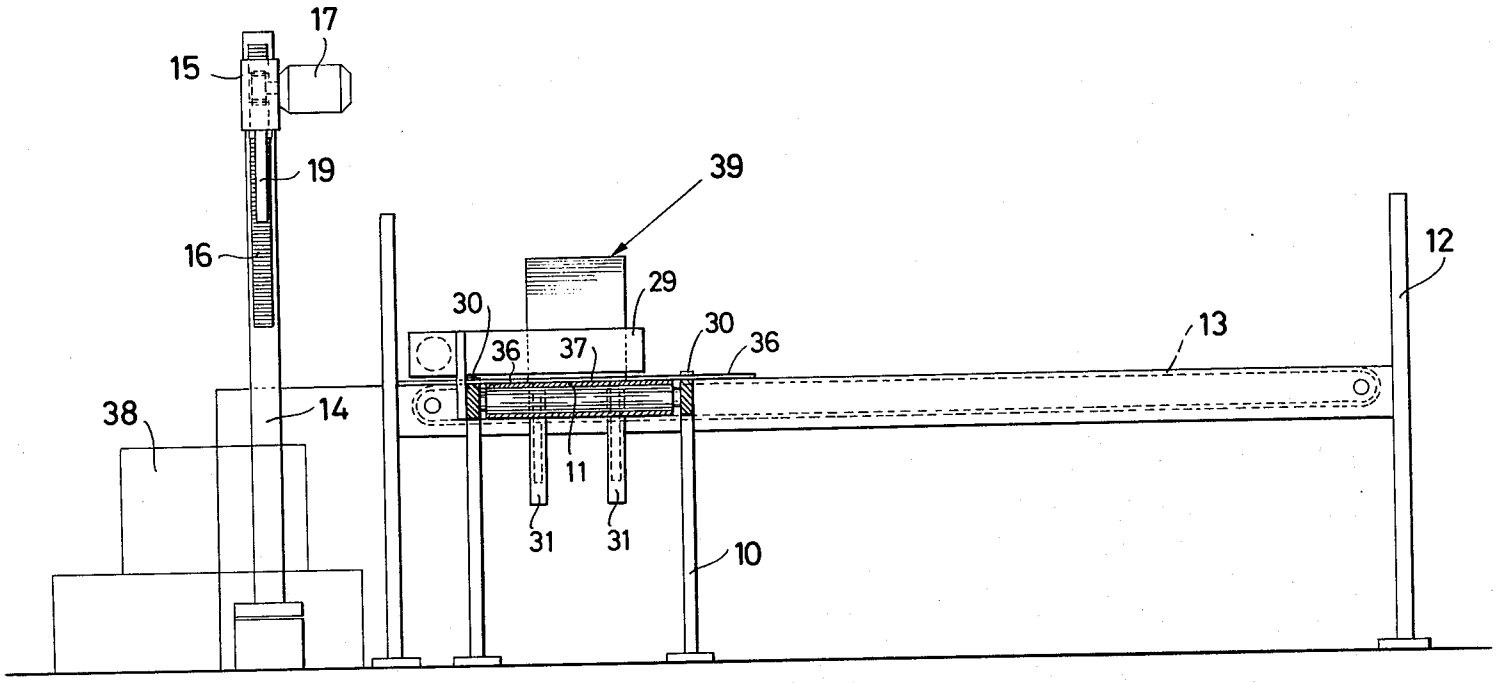
Figure 6:
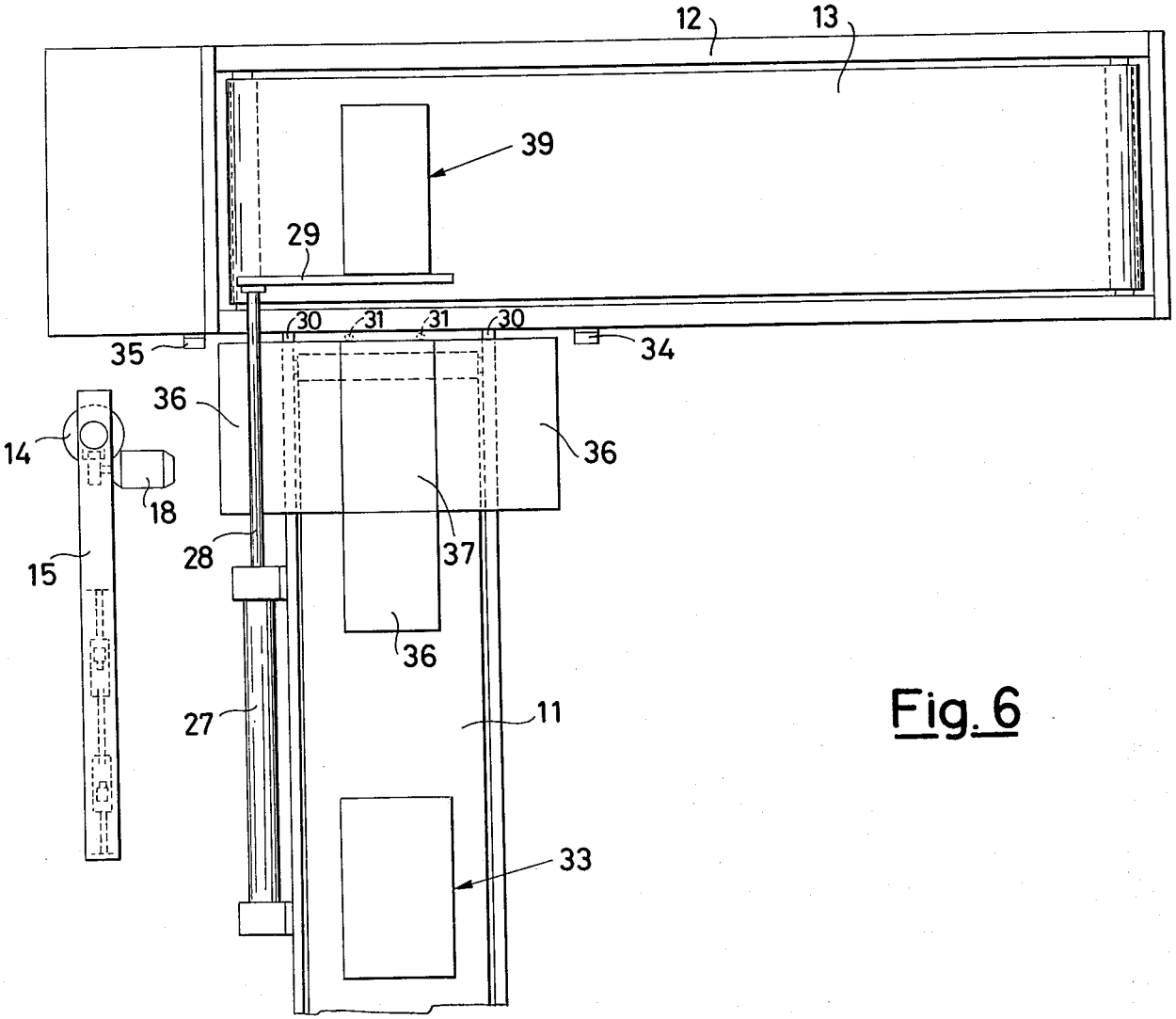
Figure 7:
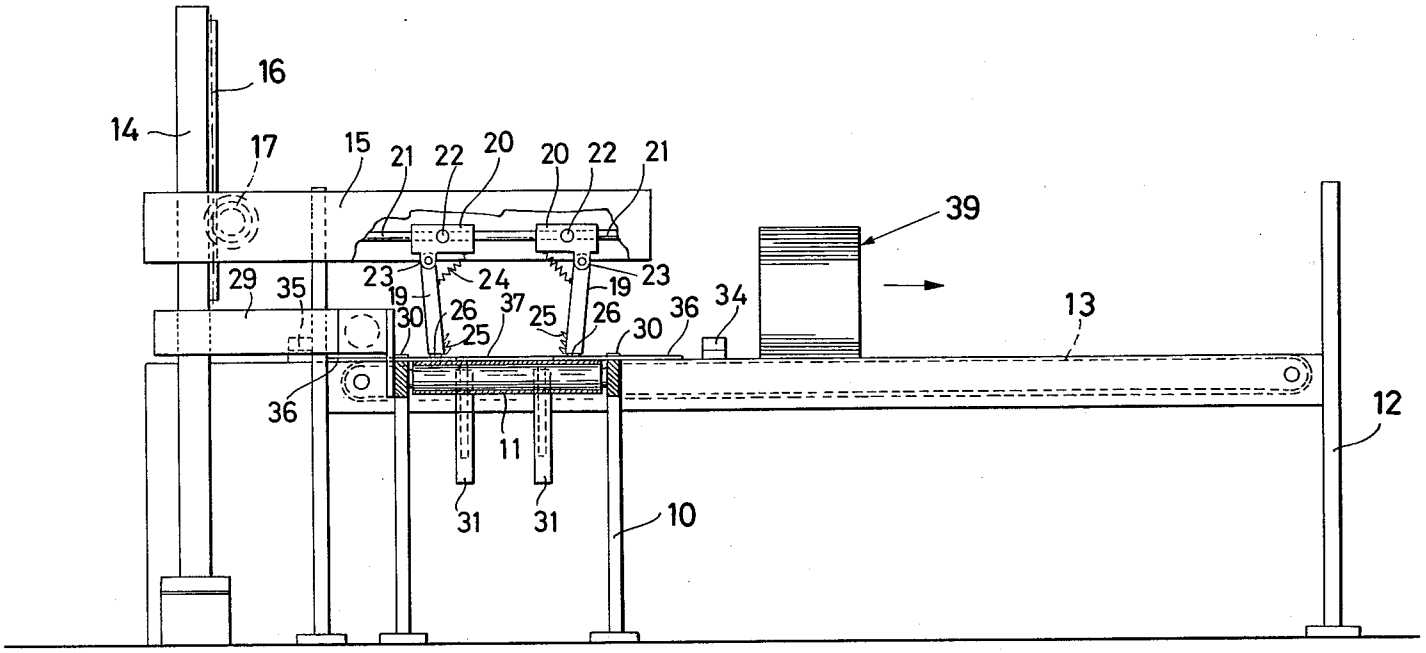
Figure 8:
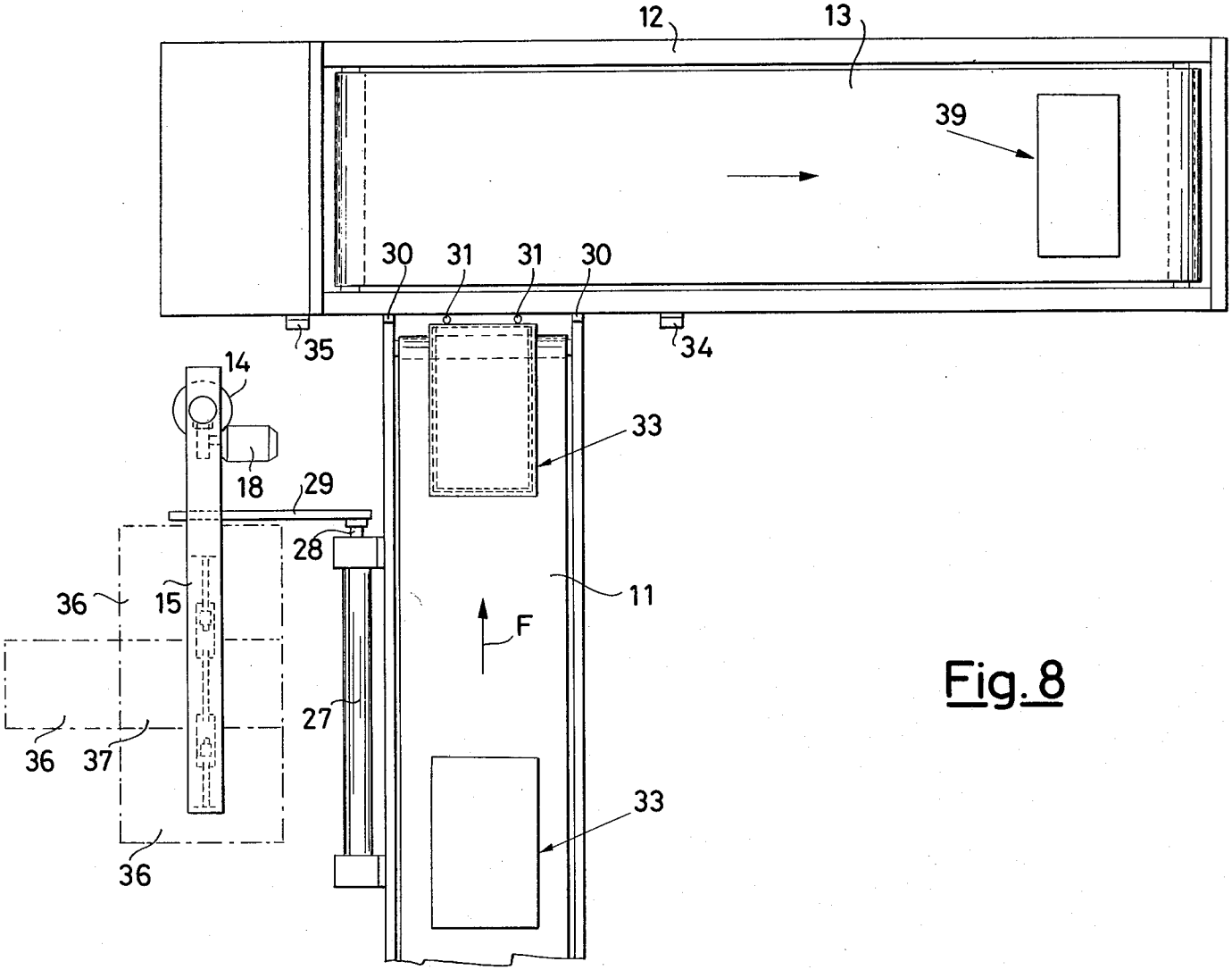

Sideways with respect to the frame 10 there is furthermore provided a thrusting removal device, comprising a jack 27 of hydraulic, oleodynamic or pneumatic type, the stem 28 of which is connected to a paddle shaped arm 29, rotatable between a rest position (shown in FIG. 1) and an operating position (shown in FIG. 5) the paddle 29 being furthermore advanced and withdrawn, by means of the jack 27, between the rest position of the operating stroke, shown in FIG. 6.

Lastly, at the end of the frame 10 a first pair of detents 30 is provided, of permanent type, protruding with respect to the plane of the conveying belt 11 by a height lower than the distance between the lower edge of the paddle and the aforesaid plane, whereas a second pair of detents 31 is movable between the operating or retaining position, shown by dashed lines in FIG. 2, and the rest position, shown by solid lines in the same figure. The means for the displacement of the detents 31 from one to another position can be of whatever known type, such as for instance pneumatic jacks.

A photoelectric cell device is furthermore provided in a suitable position so as to signal the arrival of a box 33 against the detents 31. In FIG. 1 such a device is represented by the emitter 34 and the receiver 35.

Figure 3:
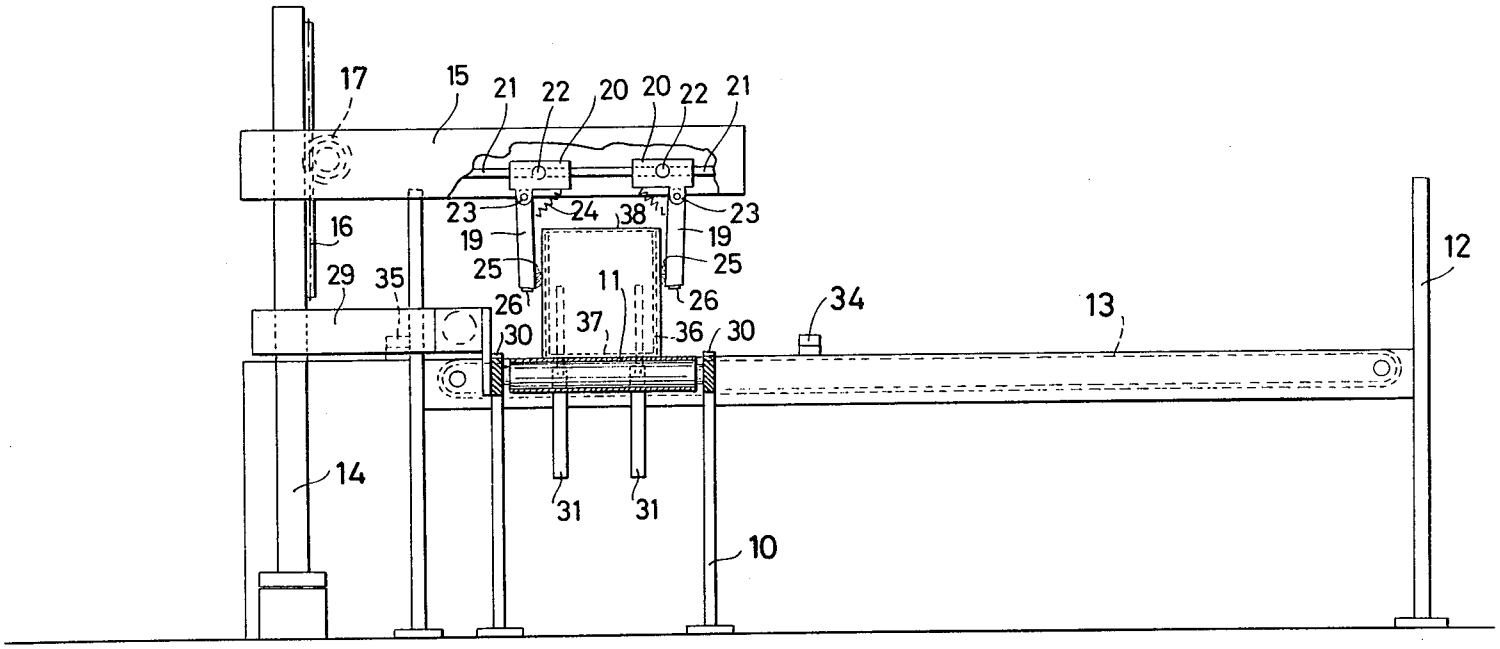
FIG. 3 is a view like to FIG. 2 showing the apparatus in a different operating condition.
Figure 4:
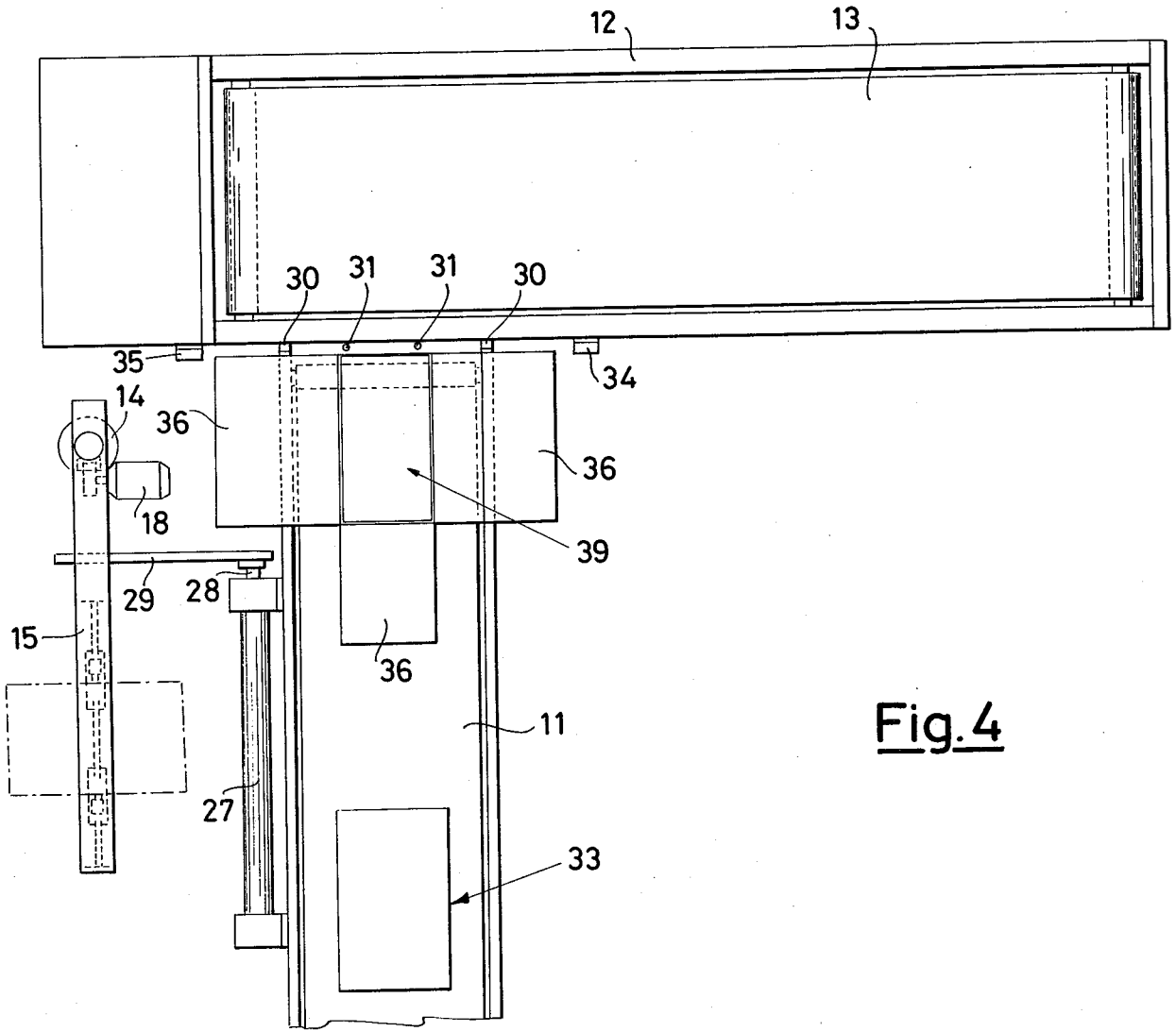
FIGS. 4,5,6, 7 and 8 are views, alternatively like to the FIGS. 1 and 2, showing the apparatus in the several operating phases of the operating cycle.

The operation of the apparatus according to the invention shall be now illustrated according to the sequence represented in the FIGS. 1 to 8, it being meant that the box 33 comprises a casing or container having vertical side panels 36 and a bottom 37, the side panels being separated at the vertical corners, whereby the container, as such, takes the configuration illustrated in FIG. 4, in which it can be also seen that the fore side panel (according to the motion direction of the box 33) is omitted. The side panels 36 are maintained in the vertical position by the cover 38, telescopically coupled to the container and thus to the side panels, whereas the form package contained in the box 33 is generically indicated by the reference 39.

As shown in FIG. 1, the box 33 is advanced by the conveying belt 11 in the direction of the arrow F, until it stops against the detents 31.

The arrival in this position is revealed by the photocell device (34,35) which in a per se known manner transmits a control signal to the means (also not shown, as being of conventional type) controlling the rotation of the column 14 and of the arm 15 from the rest position to the operating one.

When the arm 15 is in the position show in FIG. 2, the motor 18 is actuated and the arm is lowered along the rack 16 until the self-centering jaws 19 engage the sides of the cover 38 of the box 33 (FIG. 3).

The counterrotation of the motor 18 causes the arm 15 to be raised, the cover 38 being thus removed, and the side panel 36 of the container being thus made free, whereby these panels, being no longer retained, rotate by gravity until positioned in the plane of the bottom 37 of the container: the sides of the form package 39 are thus freely accessible.

Meanwhile, owing to the return of the arm 15 and of the column 14 in the rest position, the cover 38 is definitely removed and it can be folded in a flattened condition for the future reuse.

Upon this phase of the cycle is terminated, the jack 27 is actuated, which causes firstly the paddle 29 to be rotated from the position of FIG. 1 to that of FIG. 5 and then the stem 28 to be extended, whilst, simultaneously, the detents 31 are lowered so as to no longer interfere with the form package 39. At the same time the detents 30 engage the two side folded panels 36, thus preventing the casing of the box, now in form of plane panel, from being displaced in the direction of the arrow F.

The extension of the stem 28 causes a thrusting action of the paddle 29 to be applied only to the form package 39 which in this manner is compelled to slide along the bottom panel 37 and is accompanied to the conveying plane 13, thus being totally disengaged from the bottom 37 and the side panels 36.

Of course the extension distance of the stem 28 and thus the displacement of the package 39 are adjusted by means of end switches, not shown.

At this point the jack 27 is inverted and the paddle 29 is returned to the rest position. Then, (FIGS. 7 and 8), the column 14 is actuated again, in the already described manner with reference to the removal of the cover, apart that this time the bottom 37 of the container and/or the side planes 36 are engaged by the suction cups 26, whereby also this component of the box 33 is removed, thus rstoring the apparatus for the next operating cycle.

The invention has been described with reference to a preferred embodiment, it being understood that the single components can be substituted for by mechanisms having equivalent function.

It is also understood that, instead of a sliding displacement of the package 39 with respect to the bottom 37, it is possible and foreseable to use means adapted to grasp the bottom or preferably the side panels 36 and remove it from under the form package 39, whereby the latter is likewise totally set free from the box and available for further processing.

It should be noted that the receiving plane 13 may be coincident with the platform provided for the splicing apparatus disclosed in the aforesaid patent applications, or such a plane may constitute an intermediate waiting station for the splicing or whatever other operation.

Furthemore, in the preceding disclosure reference was made to a box 33, the container of which is lacking of the fore panel 36. The apparatus according to the invention may however be also used with a box having all the four side panels, provided that, when cover 38 is removed, the detens 31 are lowered, so that also the fore panel 36 is enabled to rotate downwardly, and provided that the sliding displacement of the paddle 28 and thus of the package 39 is such as to disengage the package 39 also from the fore panel.

Lastly, the apparatus according to the invention may also find use in the case of standard paper board boxes, provided that in this case there are means actuatable after the removal of the cover and adapted to carry out a cut at the corners.

There are also contemplated boxes in which the side panels are maintained in the vertical position by means of claws applied at the corners. In this case, instead of the cutting means, there will be provided means for the removal of the claws.

I claim:

1. Automatic apparatus for the positioning and removal of the casing of paper board boxes comprising a cover and container telescopically coupled, said container having a bottom panel and side panels separated from each other at the vertical corners and maintained in the vertical position by said cover, comprising:

means for moving said boxes on said bottom panel along a sliding plane in a predetermined horizontal direction to a case removal station at a predetermined position;

revealing means to signal the presence of a box at said predetermined position;

a single first means for engaging and then removing both said cover and said container respectively, in separated steps;

means for moving said first means between a rest position and an operating position in which the component to be removed is engaged by means of respective grasping means mounted on said first means and for moving said grasping means holding said cover and container, respectively, away from said predetermined position, said removal of said cover from said container allowing the separate side panels to move down to a coplanar position with respect to the bottom panel of the container;

second means for engaging an article contained in the box and means for moving said second engaging means to cause said article to slide in said predetermined direction with respect to the said container until a condition of reciprocal disengagement is attained;

means for moving said second means between a rest position and an operating position; and first and second retaining means, said first retaining means mounted in fixed position under the path of movement of said second engagement means so as to intercept the sliding displacement of said container when the side panels are in said coplanar position with respect to the bottom of the same container when the second engagement means moves said article off the container, said first engaging means removes said container from said predetermined position after the articles are removed off said container;

said second retaining means mounted adjacent said predetermined position and having means for moving said second retaining means between a position of interception of the box arriving at said predetermined position to stop its movement and a rest position in which no interception of the relative motion between the form package and the container takes place.

2. Apparatus according to claim 1, wherein said first engagement and removal means comprises an arm movable between a raised or rest position and a lowered or operating position, said grasping means comprising at least two self-centering jaws mounted on said arm and having side teeth adapted to engage the side of the cover of said box, said jaws being provided at their lower ends with respective suction cups connected to a source of vacuum.

3. Apparatus according to claim 2, wherein said arm protrudes horizontally from a column rotatable between a rest position, wherein said arm is parallel to said direction of movement of said boxes on said sliding plane and an operating position in which said arm is cross-wise positioned with respect to direction of movement at the said predetermined position.

4. Apparatus according to claim 3, wherein said jaws are pivoted to blocks secured to said arm in mutually adjustable positions.

5. Apparatus according to claim 1, wherein said second engagement means comprises a paddle member, movable between a rest position, in which it is positioned outside of said sliding plane, and an operating position in which said paddle member engages said article contained in the box and moves the article after the cover has been removed and the side panels of the container have been opened downstream by a predetermined distance with respect to said predetermined position.

6. Apparatus according to claim 5, said means for moving said second engaging means including displacement means comprising a jack having a stem, said stem being connected to said paddle member.

7. The apparatus of claim 1, wherein said revealing means comprise a photoelectric cell.

8. Apparatus according to claim 2, wherein said jaws are pivoted to blocks secured to said arm in mutually adjustable positions.

9. Apparatus according to claim 2, wherein said second engagement means comprises a paddle member, movable between a rest position, in which it is positioned outside of said sliding plane, and an operating position in which said paddle member engages said article contained in the box and moves the article after the cover has been removed and the side panels of the container have been opened downstream by a predetermined distance with respect to said predetermined position.

10. Apparatus according to claim 9, said means for moving said second engaging means including displacement means comprising a jack having a stem, said stem being connected to said paddle member.

11. Apparaus according to claim 10, wherein said arm protrudes horizontally from a column rotatable between a rest position, wherein said arm is parallel to said direction of movement of said boxes on said sliding plane and an operating position in which said arm is cross-wise positioned with respect to direction of movement at the said predetermined position.

12. The apparatus of claim 11, wherein said revealing means comprise a photoelectric cell.

* * * * *